United States Patent [19]

Hirata et al.

[11] Patent Number: 4,703,542

[45] Date of Patent: Nov. 3, 1987

[54] BUCKLE FOR SEAT BELTS

[75] Inventors: Katsuhiko Hirata; Syuzo Ishii, both of Osaka, Japan

[73] Assignee: Ashimori Industry Co., Ltd., Osaka, Japan

[21] Appl. No.: 828,517

[22] Filed: Feb. 12, 1986

[30] Foreign Application Priority Data

Feb. 12, 1985 [JP] Japan ..... 60-18914
Mar. 18, 1985 [JP] Japan ..... 60-39619

[51] Int. Cl.[4] ..... A44B 11/26

[52] U.S. Cl. ..... 24/641; 24/633; 24/636

[58] Field of Search ..... 24/636, 641, 642, 643, 24/664, 645, 633, 637, 638, 639, 652, 655, 656, 635

[56] References Cited

U.S. PATENT DOCUMENTS

| | | | |
|---|---|---|---|
| 3,969,795 | 7/1976 | Stephenson | 24/641 |
| 4,068,354 | 1/1978 | Loomba et al. | 24/641 |
| 4,069,557 | 1/1978 | Loomba | 24/641 |
| 4,182,008 | 1/1980 | Pouget | 24/645 |
| 4,310,952 | 1/1982 | Robben et al. | 24/641 |
| 4,339,854 | 7/1982 | Ikesue | 24/641 |
| 4,384,391 | 5/1983 | Lindblad et al. | 24/633 |
| 4,404,715 | 9/1983 | Sugimoto | 24/633 |
| 4,450,604 | 5/1984 | Oowada | 24/641 |
| 4,451,958 | 6/1984 | Robben et al. | 24/636 |
| 4,454,634 | 6/1984 | Haglund et al. | 24/636 |

FOREIGN PATENT DOCUMENTS

| | | | |
|---|---|---|---|
| 0040143 | 11/1981 | European Pat. Off. | 24/641 |
| 2073810 | 10/1981 | United Kingdom | 24/637 |

*Primary Examiner*—Victor N. Sakran

*Attorney, Agent, or Firm*—Birch, Stewart, Kolasch & Birch

[57] ABSTRACT

A buckle for seat belts which comprises a buckle body and a tongue plate engageable with the buckle body when inserted thereinto through an opening formed in the front end of the buckle body, the buckle body being provided with: (a) a frame comprising a bottom plate above which a path for insertion and ejection of the tongue plate is defined and a pair of side plates, (b) an ejector being mounted slidably on the bottom plate and urged always toward the opening, (c) a hook plate being supported on the side plates of the frame and having a lock pawl, (d) a pair of control slits being formed in the side plates of the frame, each control slit forming a narrow portion in the front part and an upwardly enlarged portion in the rear part, (e) a release bar having both ends disposed in the control slits, and (f) a manual operation assembly for buckle for buckle release, characterized in that (i) the release bar is shaped in a flat rectangular form in cross section, (ii) a supporter therefor is positioned on the hook plate, receiving on the plane including a supporting point of the hook plate the force of as spring positioned in rear of the supporter, (iii) the upwardly enlarged portion of each control slit forms a slanted edge in the front part thereof and (iv) the ejector is positioned in the point slightly inside the opening. This buckle can be released by a weak force and smoothly operated manually even in the dark by feeling. The buckle is excellent in durability and stability and prevents any inoperability by intrusion of foreign matters in the buckle body through the opening. Further, the buckle can be designed in a compact size.

5 Claims, 6 Drawing Figures

BUCKLE FOR SEAT BELTS

BACKGROUND OF THE INVENTION

Field of the Invention

The present invention relates to a buckle for seat belts especially in motor-vehicles which comprises a buckle body and a tongue member engageable with the buckle body. More particularly, the present invention relates to an improved buckle for seat belts of the type provided with a slide button for disengaging a tongue member from the buckle body.

Description of the Prior Art

In these years, a number of traffic accidents are reported, especially in case of motor-vehicles. Recently, therefore, the use of a seat belt has been required for seat occupants in motor-vehicles in many countries under various traffic safety regulations for preventing their injury or physiological damage caused by any traffic accident. Thus, a great number of seat belt assemblies have been developed hitherto in accordance with the traffic safety regulations. Among these assemblies, buckles are most popular and are fundamentally required to have such properties that they can be fastened or unfastened easier in a simple manual operation. Buckles generally known for this purpose consist of two coupling components, i.e. a buckle body and a tongue member engageable with the buckle body simply by being inserted thereinto. Basically, such buckle body comprises mechanical parts capable of engagement with the tongue member and a protective plastic cover for the mechanical parts which is provided with a slide button for disengaging the tongue member from the buckle body.

Specifically, a conventional buckle body comprises generally a channel-shaped frame constructed by a bottom plate and a pair of side plates upstanding from the side edges of the bottom plate and provided at one end thereof with an opening for the insertion of a tongue plate, a hook plate rotatably supported above the bottom plate and having at its end close to the opening of the frame a lock pawl engageable with the tongue plate, a round release bar disposed above the hook plate both ends of which are positioned respectively in slits formed approximately in an "L"-shape in both side plates for controlling the movement of the release bar, an ejector interposed between the bottom plate and the hook plate for ejecting the tongue plate, and a casing made usually of a plastic material and provided with a slide button capable of slidably moving the release bar away from the opening of the frame along the slits whereby the hook plate is rotated to disengage the lock pawl from the tongue plate by the action of a spring means interposed between the release bar and the tail end of the hook plate, with the result that the unlocked tongue plate is pushed out of the buckle body by the ejector.

One example of the buckles of this type is disclosed in U.S. Pat. No. 4,384,391. On actual use, a buckle disclosed in this patent is operated in the following manner: When a tongue 1 is inserted into a locking means 2 corresponding to the buckle body, an ejector 26 is pushed inside against the action of a spring 27 to press the lower end (downwardly extending branches 11) of a locking element 9 corresponding to the hook plate whereby the locking element 9 is rotated counterclockwise in FIG. 2 with an edge 44 functioning as a fulcrum to engage two legs 13 (branched at the front end of the locking element 9) with a narrowed neck part 22 of the tongue 1. When the locking element 9 is rotated counterclockwise, a catching bar 29 corresponding to the release bar is moved by the action of a spring means 38 to a portion 31 of an "L"-shaped slit 30 thereby preventing any clockwise rotation of the locking element 9 while pressing the legs 13. When a trigger 39 corresponding to the slide button is actuated by manual pressing, the catching bar 29 is pushed inside and moves from the portion 31 to a boundary point between the portion 31 and a portion 32 in the slit 30 whereby the locking element 9 is rotated clockwise in FIG. 3 with the edge 44 functioning as a fulcrum to elevate the catching bar 29 up to the portion 32 in the slit 30, with the result that the legs 13 are disengaged from the neck part 32 of the tongue 1 and then the ejector 26 pushes the tongue 1 out of the locking means 2 by the action of the spring 27.

Another example of the buckles of this type is disclosed in U.S. Pat. No. 4,451,958. According to the buckle disclosed in this patent, a tongue 2 is inserted into a base 1 corresponding to the buckle body 1 on actual operation. When an ejector 4 is pushed by the insertion of the tongue 2, a rocker 8 corresponding to the hook plate is rotated with a lateral axis element 27 functioning as an axis while keeping contact of an internal face 25 of the rocker 8 with a retaining bar 7 corresponding to the release bar. When the rotation proceeds at a certain degree, the direction of force exerted by a spring 9 is changed to give the rocker 8 a counterclockwise moment in FIG. 2 with the lateral axis element 27 functioning as a fulcrum. Thus, the movement of the retaining bar 7, a latch 5 and the rocker 8 changes from the state as shown in FIG. 5 to the state as shown in FIG. 4 wherein the tongue 2 is engaged firmly. When a release push button 10 is actuated by manual pressing, the retaining bar 7 is pushed inside and moves to the vertical wing of a cutout 26 corresponding to the slit, ramps 18 of the push button 10 are inserted below the latch 5 to push it up thereby disengaging the latch 5 from the tongue 2. The retaining bar 7 is simultaneously moved to the upper portion of the cutout 26 by the latch 5. The force of the spring 9 is then transmitted to the rocker 8 and the ejector 4 to push the tongue out of the base 1 (change from the state as shown in FIG. 5 to the state as shown in FIG. 6).

Further example of the conventional buckles is disclosed in U.S. Pat. No. 4,454,634. When a tongue 1 is inserted into a locking device 2 corresponding to the buckle body, an ejector 31 is pushed inside whereby a detent 34 is pushed down along a part 37 of a guide slot 35 by a link 42 since the ejector 31 is connected to the link 42 through a lower pivot axle 46 and the link is connected to the detent 34 at one end 43 thereof. At the same time, a locking member 9 is pushed down to the final latch position by a detent bar 34. When the detent 34 is pushed down to the lowest position of the part 37 of the guide slot 35, the link 42 receives the counterclockwise (in FIG. 5) moment with the lowest pivot axle 46 being as an axis by the force of a spring 18. The detent 34 is then moved in outward direction parallelly to the tongue 1 and positioned in the part 36 of the guide slot 35 whereby the tongue 1 is locked firmly by the locking member 9. When a buckle trigger 16 is pushed manually, the detent 34 is moved inwardly along the part 36 of the guide slot 35. As the detent 34 is connected to the link 42, the latter is also moved inwardly parallelly to the former. When the detent 34 reaches the innermost end of the part 36, the detent 34 is pushed up along the part 37 of the slot 35 by the action of the spring 18 whereby the locking member 9 is disengaged from the tongue 1 and the force of the spring 18 is then transmitted to the link 42 and the ejector 31 to push the tongue 1 out of the locking device 2.

Besides these typical buckles, there are known some similar buckles but their structures and mechanisms are basically similar to the ones above described. In these conventional buckles, however, a mechanical part corresponding to the release bar (the reference numerals 29, 7 and 34 in the aforesaid patents) is circular in cross section. In case the shape of the release bar is a round bar, the release bar is brought into contact only in a line with a mechanical part corresponding to the control slit (the reference numerals 31 and 32, 26 and 35 in the aforesaid patents) and with a mechanical part corresponding to the hook plate (the reference numerals 9, 5 and 9 in the aforesaid patents). If a strong force exerting in the outward direction, i.e. in the direction of ejection, is applied to the tongue plate when it is engaged with a mechanical part corresponding to the buckle body, the release bar will be pressed strongly against the control slit and/or the hook plate, thus forming a linear dent on the surface of either or both of the release bar and the mechanical parts contacting therewith. The formation of such dent makes it difficult to move the release bar smoothly for engaging or disengaging the buckle parts and requires an unreasonably strong force for pressing the slide button for disengaging the tongue plate from the buckle body.

According to the recent JIS and MVSS regulations concerning seat belt assemblies including buckles, various requirements are established for buckles one of which relates to "buckle release force" stipulating a minimum force for buckle release so that seat occupants may rapidly unfasten their seat belt and escape from motor-vehicles on any traffic accident even in case an excessive tension load is applied to the buckle, for example, on crash or sudden braking. According to U.S. Federal Regulations MVSS 209, S.4.3(d)(1) relating to "buckle release force", enforced from Dec. 13, 1979, for example, buckles for safety belt have to release when a force of not more than 30 lbs (or 14 kg) is applied. Whereas, the conventional buckles above described tend to form a linear dent, for example, on the surface of the release bar after the use for a certain period of time and soon become unable to satisfy the requirement for "buckle release" because of increasing the force necessary for disengagement with the use time.

On the other hand, this problem may be solved if the release bar is formed from a plate having a rectangular form in cross section instead of a round bar, thereby increasing the contact area between the release bar and the control slit and/or hook plate. In case the round release bar is simply replaced with a rectangular release bar, however, it will often be tilted or rotated on reciprocally moving along the control slit having a complicate contour, thus failing to afford a smooth movement of the release bar. Hence, such unstable movement of the release bar may cause a fundamental mechanical fault in buckle mechanism.

The conventional buckles include such a type wherein the hook plate is supported at the lower end of its base on the bottom plate and is rotatable by a spring means in the direction of disengagement for buckle release. In this type, a friction force is exerted between the hook plate and the tongue plate and tends to disturb smooth rotation of the hook plate so that there is a possibility of failing to disengage the hook plate from the tongue plate when a tension is exerted to the buckle.

In the buckles disclosed in U.S. Pats. Nos. 4,451,958 and 4,454,634, for example, the ejector (the reference numerals 4 and 31, respectively) is connected to the supporter (the reference numerals 8 and 42, respectively) for holding and moving the release bar (the reference numerals 7 and 34, respectively). For saving the number of mechanical parts, however, only one spring means (the reference numerals 9 and 18, respectively) is used in these buckle bodies for dual purposes of moving both supporters and ejectors. In general, the action of a coil spring is exerted in a linear axial direction by elongation and compression of the coil spring. In case of the spring 9 and 18, however, the action of the coil spring used is exerted in a special direction (through a curved route). Thus, the spring means used in these buckles cannot withstand a great number of repeated uses and is poor in durability.

In case of buckles of the type disclosed in U.S. Pat. No. 4,384,391, the locking element 9 is always urged by a spring means toward the opening for insertion of the tongue plate when the buckle is not in action. According to such mechanism, the location of the hook plate generally becomes higher relative to the bottom plate so that the size of the buckle body, especially in the direction of height becomes naturally greater. In this case, it is quite impossible to design the buckle body in a compact size.

In a motor-vehicle, a buckle for seat belt is generally equipped in upstanding form to either side of a seat by means of a wire or to the inner side of the vehicle body by means of a short webbing while a tongue plate is mounted to the front end of a long webbing. In twilight or at night, a seat belt has to be fastened correctly with a buckle in the dark or under insufficient illumination. Thus, the buckle has to be easy for handling so that a seat occupant may feel for correct insertion of the tongue plate into the buckle. For this purpose, the opening of the buckle for insertion of the tongue plate preferably has such a structure that the tongue plate may be inserted by anyone into the opening merely by feeling. Further, the opening of the buckle, which is opened upward when the buckle is in an upright position, has such a structure that the opening may accept insertion of the tongue plate but reject intrusion of foreign matters such as coins or the like flat metal tips. When a coin is inadvertently entered in a buckle body of the conventional buckle through the opening for the tongue plate, it is no longer possible to insert the tongue plate into the buckle body containing a coin or the like foreign matter and it is usually very difficult to take out the coin migrating inside the buckle body.

Thus, the prior art buckles for seat belts have some or all of the above mentioned drawbacks and there is a great demand in the automobile industry for developing a new type buckle devoid of such drawbacks.

BRIEF DESCRIPTION OF THE INVENTION

Accordingly, it is an object of the present invention to provide a buckle for seat belts which can be released by a weak force and thus satisfies the requirement for buckle release force.

It is another object of the present invention to provide a buckle for seat belts which can smoothly be operated manually even in the dark by feeling.

It is still another object of the present invention to provide a buckle for seat belts having a stable mechanism which withstands a great number of repeated uses.

It is further object of the present invention to provide a buckle for seat belts which can be designed in a compact size.

It is still further object of the present invention to provide a buckle for seat belts which can reject admission of foreign matters in the buckle body through an opening for the tongue plate.

Other and further objects, features and advantages of the present invention will become apparent more fully from the following descripton.

DETAILED DESCRIPTION OF THE INVENTION

As a result of extensive researches made by the present inventors to develop an improved buckle for seat belts which is devoid of the drawbacks as seen in the conventional buckles, it has now been found that all of the drawbacks can be overcome if a conventional buckle is improved by using a combination of the following specific conditions: (a) a combination of a release bar and a control slit having specific structures, (b) the location of a hook plate with its swing fulcrum being positioned above the sliding path of an ejector, (c) a specific direction of a spring force exerted to the release bar, (d) an opening for a tongue plate in a specific funnel shape and (e) the location of the front end of the ejector positioned in the opening for the tongue plate.

In accordance with the present invention, there is provided a buckle for seat belts which comprises a buckle body and a tongue plate engageable with the buckle body when inserted thereinto through an opening formed in the front end of the buckle and disengageable therefrom when a manual operation assembly of the buckle body is brought to action, the buckle body being provided with:

(a) a frame having a channel shape in cross section and comprising a bottom plate above which a path for insertion and ejection of the tongue plate is defined and a pair of side plates facing each other and upstanding from the side edges of the bottom plate, (b) an ejector being mounted slidably on the bottom plate and urged always toward the opening for insertion of the tongue plate by the action of a spring positioned in the rear end of the ejector so that it may touch the front end of the tongue plate inserted through the opening and eject the tongue plate, (c) a hook plate being supported on the side plates of the frame in such configuration that the rear portion of the hook plate may be swinged in vertical direction with the swing fulcrum being positioned above the ejector while the front portion extends downwardly to form a lock pawl capable of being moved downwardly beyond the path of the tongue plate so as to lock it, (d) a pair of control slits being formed in the facing side plates of the frame in front of the swing fulcrum in such configuration that the front part of each control slit forms a narrow portion while the rear part of each control slit forms an upwardly enlarged portion, (e) a release bar extending in transverse direction to the lengthwise direction of the frame and having both ends disposed in the control slits in such manner that the release bar may slide on the hook plate, the release bar being always urged toward the narrow portion of the control slits by means of a spring positioned in rear of a supporter for the release bar so that when the release bar is positioned in the narrow portion of the control slits, the hook plate may be pressed by the release bar against the ejector to secure locking of the tongue plate with the lock pawl, and (f) a manual operation assembly being positioned in the front end of the buckle body and being reciprocally slidable in the lengthwise direction of the buckle body when operated manually, so as to remove the release bar from the narrow portion to the upwardly enlarged portion in the control slits thereby cancelling the pressing of the release bar against the hook plate while disengaging the lock pawl from the tongue plate, characterized in that the release bar is shaped in a flat rectangular form in cross section and the supporter is positioned on the release bar in such configuration that the supporter may slide together with the release bar on the hook plate, integrally covering the release bar, and may receive on the plane including the swing fulcrum of the hook plate the force of the spring positioned in rear of the supporter, and that the upwardly enlarged portion of each control slit forms a slanted edge in the front part thereof continuing to the front narrow portion, showing an arrangement such that when the release bar is disposed in the upwardly extended portion to swing the hook plate upwardly for unlocking the tongue plate, the release bar is contacted with the slanted edges so as to facilitate a downward swing of the hook plate, and on the other hand, the ejector is moved to the front end of the buckle body by the action of a spring positioned in rear of the ejector in such manner that the lower end of the lock pawl engaged with the tongue plate may be attached to the upper part of the ejector.

The present invention can more fully be understood from the following description taken in conjunction with the accompanying drawings in which.

The buckle of the present invention consists of two coupling components; a buckle body A as a locking component and a tongue plate B as a lockable component. In motor-vehicles, the buckle body A is connected with a flexible webbing or with wires in self-standing state, while the tongue plate is usually connected to the front end of a long webbing the length of which is adjustable.

Figure 1:
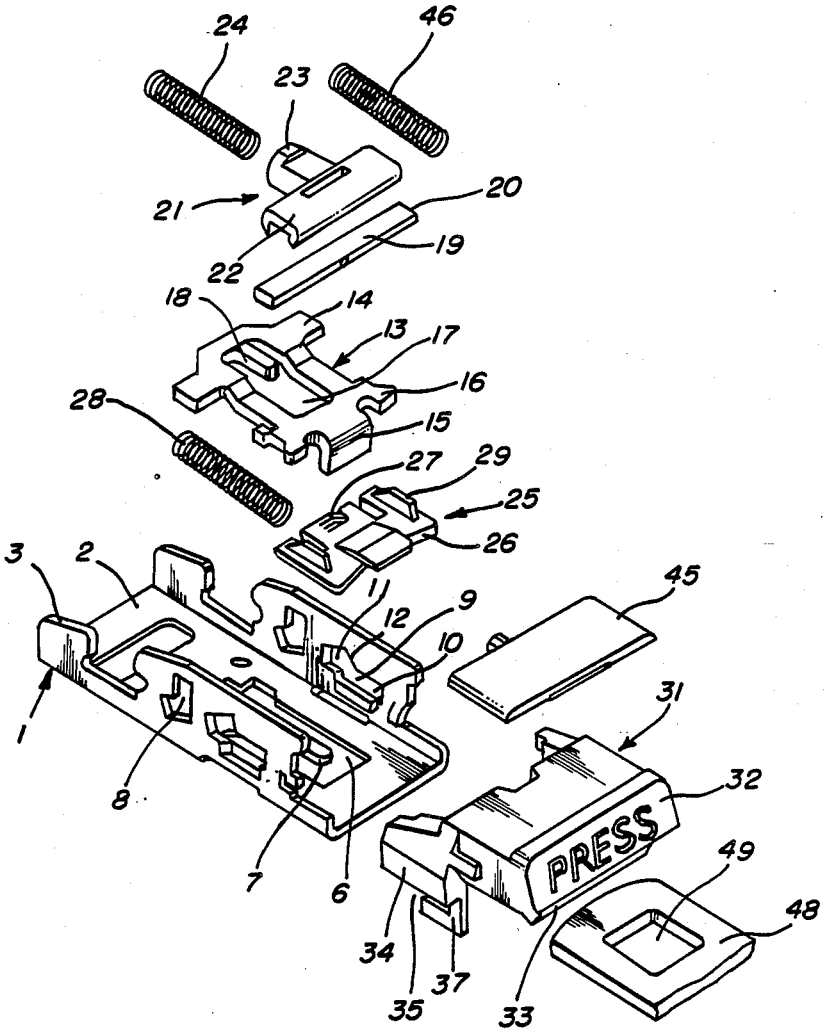
FIG. 1 is an exploded view of one example of the buckle of this invention showing mechanical parts constructing the buckle body without a casing thereof together with a tongue plate in fracture.

Referring to the drawings, especially FIG. 1 showing the buckle body A without a casing enclosing mechanical parts, a frame 1 usually made of a metal plate is formed by a bottom plate 2, on which a passage for insertion of the tongue plate B is defined, and a pair of side plates 3 upstanding from both side edges of the bottom plate 2. Thus, the frame 1 approximately shows a channel-shape in cross section.

The bottom plate 2 has one end (the rear end) to which a buckle supporting member 4 such as a wire is connected and the other end (the front end) provided with an opening 5 for insertion of the tongue plate B. The bottom plate 2 has an elongated hole 6 in its central part and a spring support 7 projects from the rear end of the hole 6 which is closer to the buckle supporting member 4.

In each of the side plates 3 are formed a supporting hole 8 and a control slit 9. The hole 8 is formed in the rear part of the frame 1 while the control slit 9 is formed in the front end of the frame 1 closer to the opening 5. The slit 9 has a narrow portion 10 in its front part close to the opening 5 and an upwardly enlarged portion 11 in its rear part remote from the opening 5. The front side of the upwardly enlarged portion 11 closer to the opening 5 forms a slanting edge 12 forming a downward slope which continues to the adjacent horizontal narrow portion 10.

A hook plate 13 is disposed above the bottom plate 2 of the frame 1 in such manner that a pair of laterally projecting wings 14 formed at the rear end of the hook plate 13 are respectively located in one of the supporting holes 8 so that the hook plate 13 may swing or rotate above a point P in each wing 14 relative to the frame 1. The central part of the front end of the hook plate 13 is bent downwardly to form a lock pawl 15 which is engageable into the elongated hole 6 formed in the bottom plate 2 when the hook plate 13 is rotated downwardly. The both sides of the basal part of the lock pawl 15 extend to form a pair of upwardly inclined projections 16. The hook plate 13 has a hole 17 in the central part thereof and a spring support 18 projecting from the rear end of the hole 17. The rear part of the hook plate 13 is elevated relative to the front part.

A release bar 19 having a rectangular form in cross section is provided above the hook plate 13, both ends 20 of which extend respectively through the control slits 9 formed in the side plates 3 and project from the external surface of the side plates 3. A supporter 21 has a portion 22 for holding the release bar 19 and a spring support 23 located in the hole 17 of the hook plate 13 and is slidable together with the release bar 19 on the upper surface of the hook plate 13 in lengthwise direction of the buckle body A. A coil spring 24 interposed between the spring supports 18 and 23 urges the supporter 21 always toward the lock pawl 15 on the hook plate 13.

An ejector 25 has a pressure body 26 disposed between the bottom plate 2 and the hook plate 13 and a spring support 27 located in the hole 6 of the bottom plate 2. The ejector 25 is slidable in longitudinal direction of the buckle body A along the path of the tongue plate B on the bottom plate 2. A coil spring 28 interposed between the spring supports 7 and 27 urges the ejector 25 always toward the opening 5 in such manner that the front end of the pressure body 26 almost reaches the opening 5. The ejector 25 has a pair of projections 29 on its top surface which are almost contacted with the inwardly bent front ends of the inner wall of the side plates 3 to assure the straight moving of the ejector 25 on the bottom plate 2.

A slide button 31 as a manual operation assembly for buckle release is usually made of a plastic material similar to a casing and has substantially the shape of a box having an open bottom and an open rear end. The slide button 31 is partially exposed on the upper front end and is slidable in lengthwise direction of the buckle body A along the frame 1. The exposed front end of the slide button 31 form an operation part 32 having a tapered surface 33 at its lower half. The slide button 31 includes a pair of side walls 34 each having a recess 35 at its innermost end. The ends 20 of the release bar 19 projecting from the side plates 3 of the frame are located in the recesses 35. The operation part 32 is provided on its inner surface with a pair of ribs 36 each having a wedge-like projection 37 at its lower end. When the slide button 31 is manually pressed, the projections 37 slip below the projections 16 of the hook plate 13 and abut against the projections 29 of the ejector 25.

A casing 38 consists of an upper cover 39 and a lower cover 40. The upper cover 39 has at its upper front end a large opening 41 in which the slide button 31 is placed. The upper cover 39 has at its lower front end 42 a pair of tapered side walls 44 and also a tapered bottom wall 43. The tapered walls 43 and 44 form together with the tapered surface 33 of the slide button 31 a funnel-like recess the innermost part of which is opened in the form of a slot to form the opening 5 for the tongue plate B. The top of the slide button 31 is covered by a flat plate 45 which displays a dual function of protecting the upper part of the slide button 31 and supporting at a projection positioned in the central rear end thereof a coil spring 46 interposed between the flat plate 45 and a spring support positioned in an intermediate to rear part 47 of the inner surface of the upper cover 39. Thus, the slide button 39 is always urged by the action of the spring 46 toward the front end of the buckle body A.

On the other hand, the tongue plate B has at its front end a tongue 48 to be inserted into the buckle body A and a square or rectangular lock hole 49 in which the lock pawl 15 is engageable. The tongue plate B is connected in the rear end thereof to a seat belt.

The tongue-locking mechanism and the buckle release mechanism of the buckle of the present invention are obvious from the following description and the illustrations shown in FIGS. 2, 3A, 3B, 4A and 4B.

Figure 2:
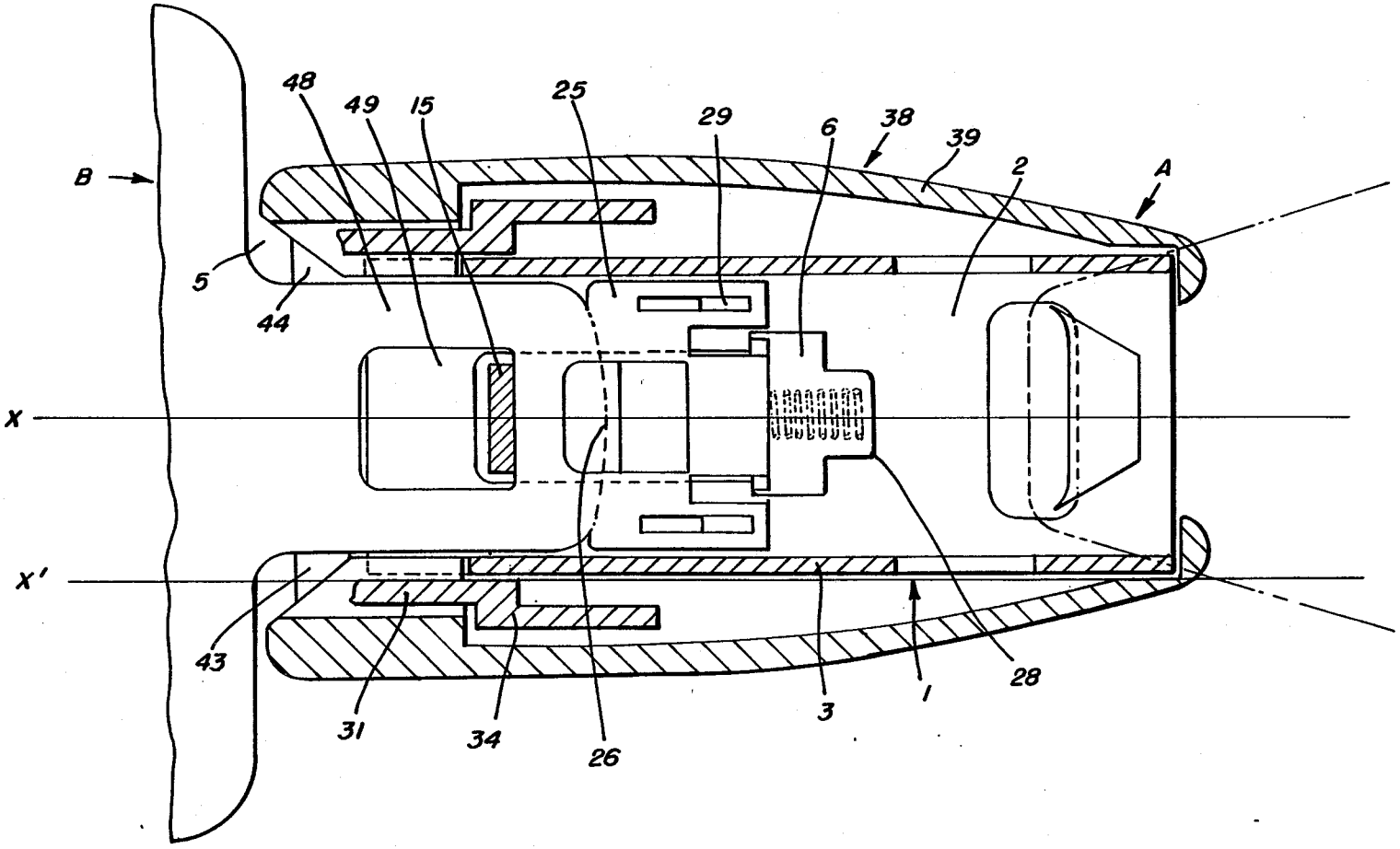
FIG. 2 is a plan view of the buckle shown in FIG. 1 in locked state, partially cut away in the tongue plate.

In FIG. 2, the tongue plate B is locked with the buckle body A in such manner that the lock pawl 15 at the front end of the hook plate is engaged into the lock hole 49 of the tongue 48. The contact surface of the pressure body 26 is preferably in compliance with the shape of the front end of the tongue 48. The funnel-like structure formed by the tapered surfaces 33, 43 and 44 in the opening 5 facilitates insertion of the tongue plate into the buckle body even in the dark by feeling.

Figure 3A:
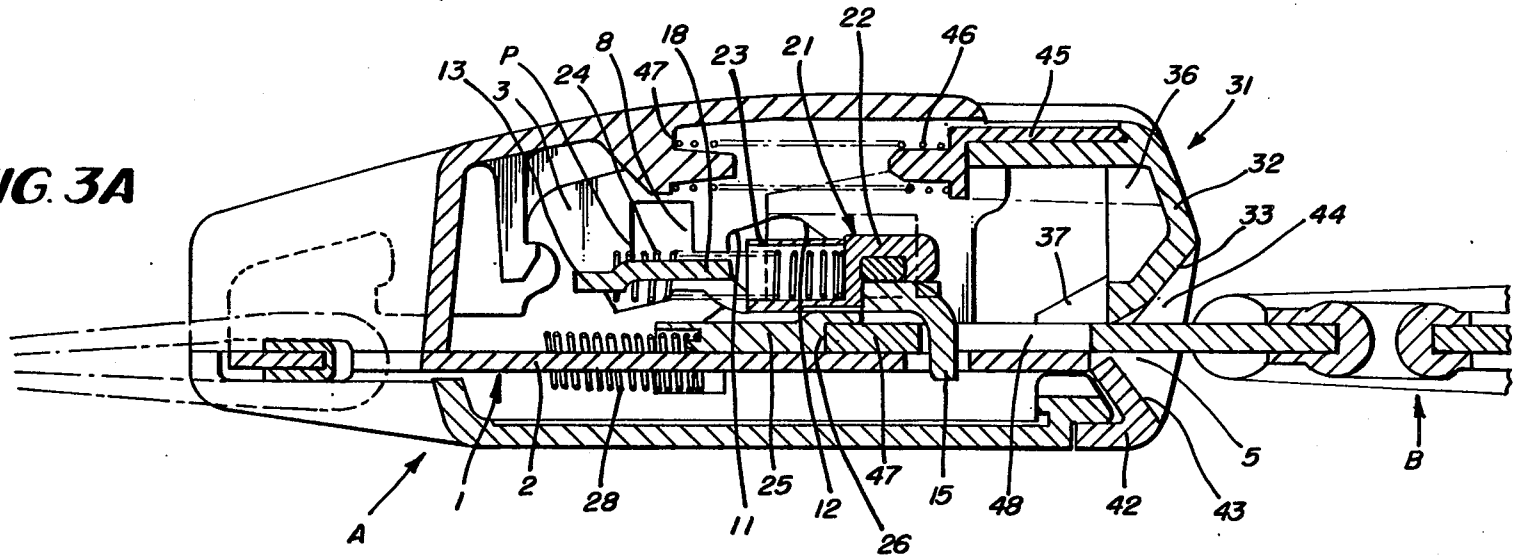
FIG. 3A is a longitudinal section view of the buckle shown in FIG. 2 cut along the line X-Y, showing the function of the individual mechanical parts of the buckle in locked state.
Figure 3B:
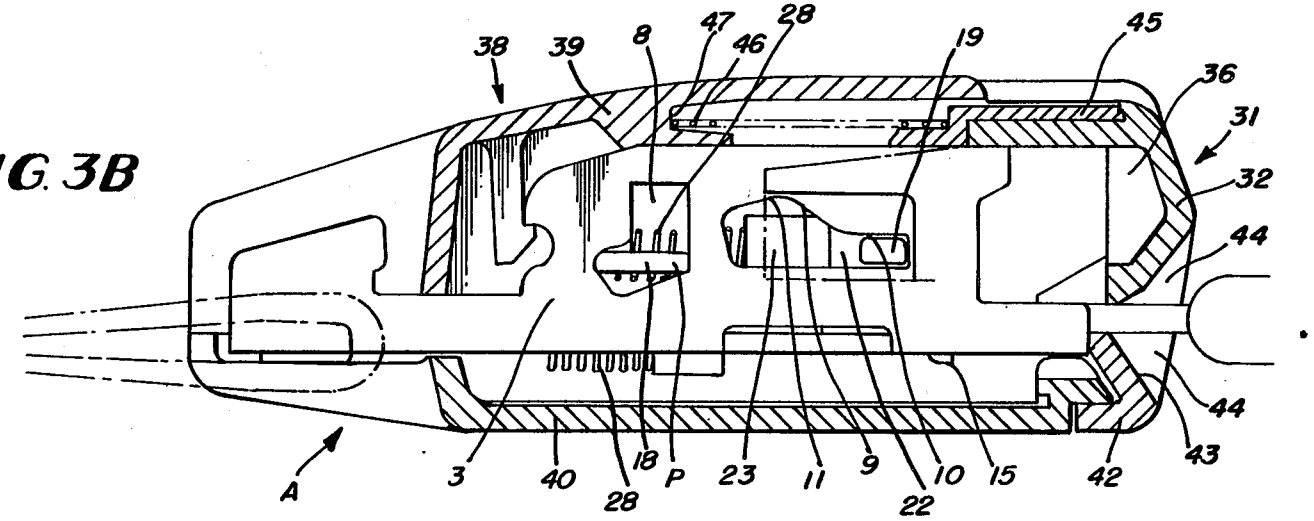
FIG. 3B is a longtiudinal section view of the buckle shown in FIG. 2 cut along the line X'-Y', showing the shape of a specific control slit in locked state and the position of a specific release bar therein.

FIGS. 3A and 3B are longitudinal section views of the buckle in locked state, the former showing the central part of the inside cut along the central line X-Y in FIG. 2 and the latter showing the side plate of the frame cut along the side line X'-Y' in FIG. 2.

Figure 4A:
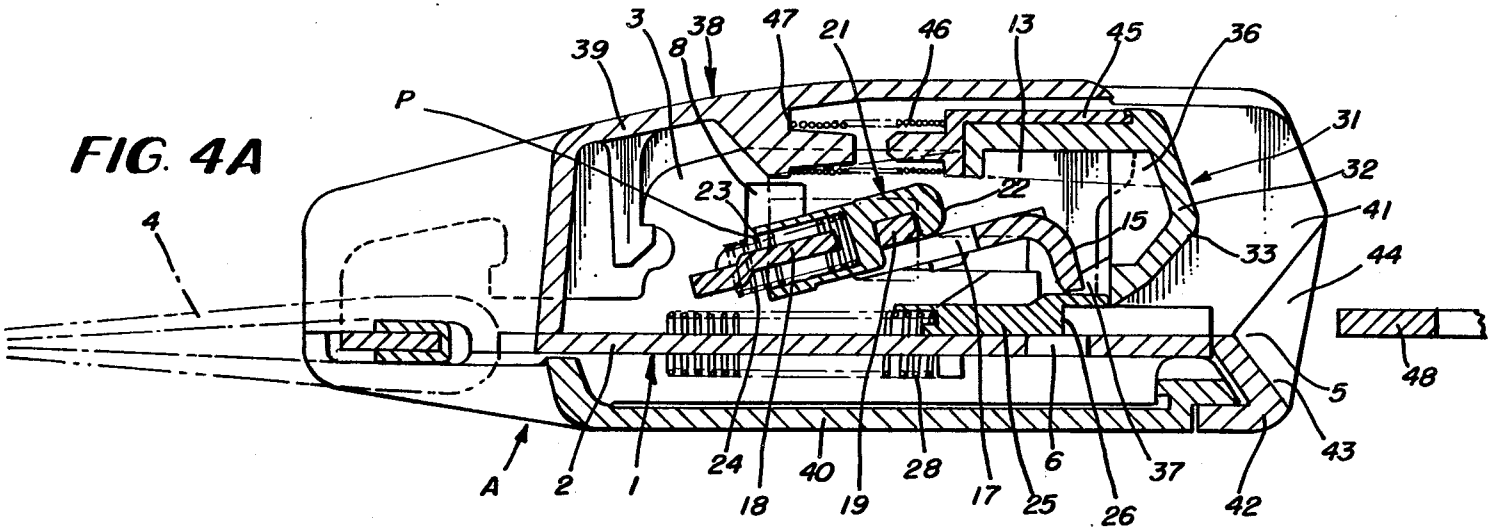
FIG. 4A is a longitudinal section view of the buckle shown in FIG. 2 corresponding to FIG. 3A but in unlocked state, showing the arrangement of the mechanical parts of the buckle in unlocked state.
Figure 4B:
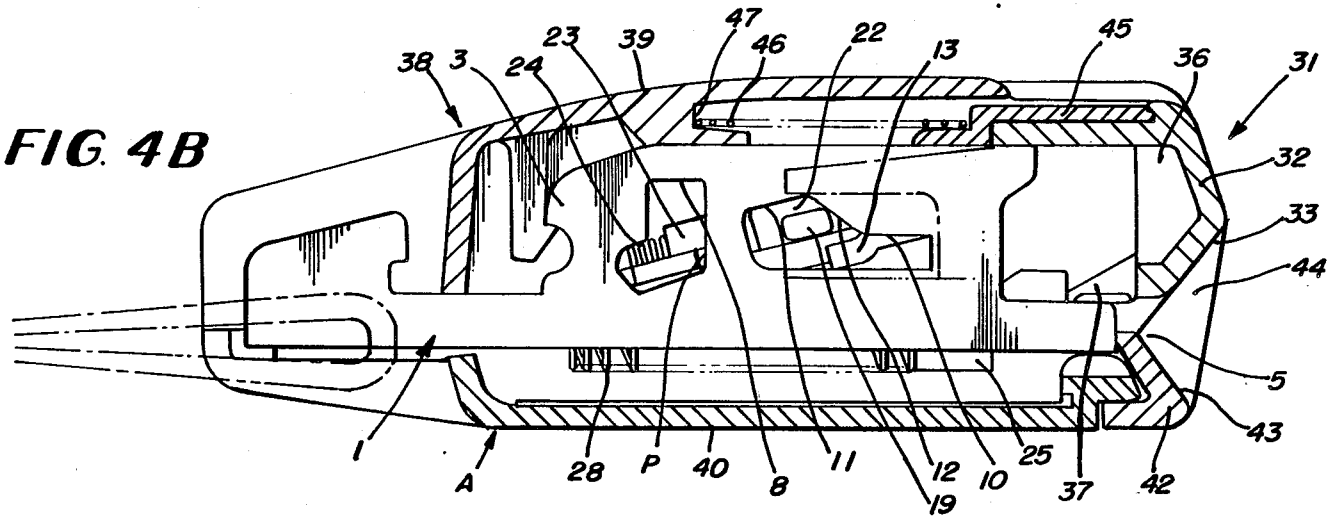
FIG. 4B is a longitudinal section view of the buckle shown in FIG. 2 corresponding to FIG. 3B but in unlocked state, showing the shape of the control slit and the position of the release bar therein in unlocked state.

FIGS. 4A and 4B are longitudinal section views of the buckle in unlocked state corresponding to FIGS. 3A and 3B, respectively. These drawings are to show the function of the individual mechanical parts and the relation between the lock mechanism and the position of the release bar in the control slit.

On operation of the buckle, the tongue 48 of the tongue plate B is inserted through the opening 5 of the buckle body A into the tongue plate passage defined above the bottom plate 2 of the frame 1 whereby the front end of the tongue 43 pushes the pressure body 26 and causes the ejector 25 to retract to its inner position against the force of the spring 28. The hook plate 13 is allowed to rotate around the points P in the wings 14 located in the supporting hole 8 so that the front end of the hook plate 13 forming the lock pawl 15 rotates downward by the downwardly exerting force and drops into the lock hole 49 and the elongated hole 6 of the frame 1 as soon as the lock hole 49 passes below the lock pawl 15. As the supporter 21 is urged by the spring 24 to slide nearer to the lock pawl 15 on the surface of the hook plate 13, the release bar held by the holding portion 22 of the supporter 21 is also moved closer to the lock pawl 15 whereby the both ends 20 of the release bar 19 are located in the narrow portions 10 of the control slit 9. The slide button 31 is pushed by the release bar 19 so that the button 31 projects from the opening 41 of the upper cover 38. In this state, the release bar 19 is positioned on the hook plate 13 close to the lock pawl 15 and both ends 20 of the bar 19 are located in the narrow portion 10 of the control slit 9 so that the hook plate 13 is unable to rotate upwardly and the lock pawl 15 is maintained in locked state in the hole 49 of the tongue plate B. Thus, disengagement of the tongue plate B from the buckle body A is entirely prevented.

The tongue plate B is unlocked from the buckle body A by pressing the operation part 32 of the slide button 31 by hand. By this operation, the slide button 31 is pushed into the opening 41 whereby the projected ends 20 of the release bar 19 are pushed by the edges of the recesses 35 to slide backward along the edges of the control slit 9. The release bar 19 and the supporter 21 are then slidably moved on the surface of the hook plate 13 toward the points P whereby the ends 20 of the release bar 19 are displaced in the upwardly enlarged portions 11 of the control slits 9. The rotation of the release bar 19 in upward direction is then possible and the hook plate 13 can swing upwardly with the points P functioning as a fulcrums for rotation.

On the other hand, the ejector 25 is pushed in locked state by the force exerted by the spring 28 positioned in rear of the ejector 25 so as to eject the tongue plate B out of the opening. In such state, the hole 49 of the tongue 48 is pressed at its front edge against the lock pawl 15 of the hook plate 13. As the lock pawl 15 is spaced stepwise from the points P around which the hook plate 13 is rotatable, an upward component of force is exerted to the lock pawl 15 since the inserted tongue plate B is always pushed by the ejector 25. Once the force inhibiting the rotation of the hook plate 13 has been cancelled as a result of pressing the slide button 31 manually, the hook plate 13 rotates around the points P so as to unlock the lock pawl 15 from the tongue plate B. As soon as the lock pawl 15 unlocks the hole 49, the spring 28 urges the ejector 25 to eject the tongue plate B out of the buckle body A. The force of the spring 28 allows the ejector 25 to slide along the bottom plate 2 toward the opening 5. The forward movement of the ejector 25 is stopped when the projection 29 presses the projection 37 of the slide button 31 (FIGS. 4A and 4B).

When the slide button 31 is released from the manual pressure, the spring 28 allows the ejector 25 to slide toward the opening 5 and at the same time the projection 29 pressing the projections 37 causes the slide button 31 to slide outwardly until it projects from the opening 41. The spring 46 directly assists the movement of the slide button 31 to the original position. As the front end of the ejector is positioned in the point slightly inward the opening 5, the buckle body A prevents intrusion of any foreign matter such as coin in normal conditions.

As the release bar 19 is released from the force exerted by the slide button 31, the release bar 19 is allowed to slide together with the supporter 21 on the hook plate 13 to the front end of the control slit 9 until both ends 20 reach the slanted edges 12 of the control slits 9. The inclination of the slanted edges 12 produces a downward component of force which urges the hook plate 13 toward the bottom plate 2. As the spring 28 holds the ejector 25 in its advanced position, however, the lock pawl 15 abuts on the upper surface of the ejector 25 to prevent further rotation of the hook plate 13 in downward direction (FIGS. 4A and 4B). The buckle body A is thus reinstated to the original state.

According to the buckle of the present invention, the release bar 19 is rectangular in cross section and so can be contacted over the whole surface with the flat hook plate 13 without causing any damage in either or both of the parts, unlike a conventional release bar which is circle in cross section and cause a dent on the contact surface during the use. Thus, the buckle of the present invention can be operated smoothly even if a heavy load is applied to the seat belt. As the release bar 19 which is rectangular in cross section is held always by the supporter 21 which is slidably movable on the surface of the hook plate 13, the release bar 19 works reliably and stable against tilt or rotation.

In the buckle body A of the present invention, the points P are located at a sufficiently high level above the bottom plate 2 and apart stepwise from the lock pawl 15. Thus, the lock pawl 15 is movable away from the engagement with the tongue plate B when the hook plate 13 is rotated. As soon as the release bar 19 is displaced into the upwardly enlarged portion 11 of the control slit 9, the force of the spring 28 causes the hook plte 13 rotate to disengage the tongue plate. Even if a strong force is applied to seat belt, such tension force rather serves to assist the disengagement of the hook plate 13 from the tongue plate B.

The buckle body A of the present invention is stable against any inoperability by intrusion of any foreign matter such as coin, since the ejector 25 is always located substantially in the opening 5 for the tongue plate B when the buckle is not used.

In the buckle of the present invention, the hook plate 13 has a pair of projections 16 and the slide button 31 has a pair of projections 37 adapted to abut on the lower ends of the projections 16. Even if the function of the hook plate 13 is insufficient, the projections 37 slip below the projections 16 and push up them to urge the rotation of the hook plate 13, thus ensuring the more reliable movement of the hook plate 13.

The opening 5 for the insertion of the tongue plate B is formed by a combination of the slide button 31 having a tapered surface 33 and the upper cover 38 having tapered side walls 44 and the tapered bottom wall 43 to form a funnel-like opening so that the insertion of the tongue plate B into the buckle plate A can be made easily even in the dark or under insufficient illumination by feeling.

The buckle of the present invention can be designed in a compact size because the mechanical parts can wholly be arranged in a relativley small size frame and need not use a conventional release mechanism as described hereinbefore with respect to U.S. Pat. No. 4,384,391. In the buckle of this invention shown in the drawings, the funnel-like opening for the purpose of facilitating the insertion of the tongue plate into the buckle body is constructed by a combination of the slide button forming the upper part of the opening and the upper cover forming the side and bottom parts of the opening, each part having a backwardly inclined tapered surface. However, some modifications of this embodiment is possible in such manner that the side and bottom parts of the funnel-like opening are formed exclusively by the lower cover or the side parts may be formed by the upper cover while forming the bottom part by the lower cover. In addition, a modification of the ejector is possible in such manner that the ejector may partially be touched at its projections 29 or at other parts to the slide bottom so that the ejector may slidably be moved together with the manual operation assembly in lengthwise direction of the buckle body when the tongue plate is not inserted into the buckle body. In the buckle of the present invention, the shape of the casing of the buckle body, the shape of the tongue plate, etc. can be modified properly in accordance with aesthetic desires of the users so far as the characteristic mechanism of the buckle body of this invention is not changed.

In order to check the condition of the buckle, for instance, the state of whether the buckle is correctly locked or not, the use condition of the buckle may be displayed electrically on an instrument board or panel in such manner that the buckle body is provided electric contacts (not shown in the drawings) positioned, for example, between the lower cover and the bottom or side of the ejector or between the buckle body and the tongue plate acting per se as an electric contact so that when the buckle body is correctly locked with the tongue plate, an electric circuit is made up to illuminate a warning lamp on the instrument board or panel. If necessary, the casing of the buckle body and the tongue plate may be incorporated with a liminous material or provided with a very small LED illumination equipment for facilitating the manual operation of the buckle in the dark.

Among the mechanical parts, the casing 38, the manual operation assembly 31, the ejector 25 and the supporter 21 may be made of a hard resinous material. The durability and stability of the buckle of this invention is not affected by such substitution of the material.

As the buckle of the present invention succeeds in overcoming all the drawbacks as seen in the conventional buckles by a combination of the specific devices and requires no extra expenses for its production, the buckle of this invention finds a wide advantageous utility, especially in automobile industry.

Throughout the specification, the front end of the buckle body means the end of the body where the opening for the tongue plate exists.

What is claimed is

1. A buckle for seat belts which comprises a buckle body and a tongue plate engageable with the buckle body when inserted thereinto through an opening formed in the front end of the buckle body and disengageable therefrom when a manual operation assembly of the buckle body is brought to action, the buckle body being provided with:

(a) a frame having a channel shape in cross section and comprising a bottom plate above which a path for insertion and ejection of the tongue plate is defined and a pair of side plates facing each other and upstanding from the side edges of the bottom plate, (b) an ejector slidably mounted on the bottom plate and urged always toward the opening for insertion of the tongue plate by the action of a spring positioned in the rear end of the ejector so that it may contact the front end of the tongue plate inserted through the opening and eject the tongue plate, (c) a hook plate supported on the side plates of the frame in such configuration that the rear portion of the hook plate swings in the vertical direction with the swing fulcrum being positioned above the ejector while the front portion extends downwardly to form a lock pawl capable of being moved downwardly beyond the path of the tongue plate so as to lock it, (d) a pair of control slits being formed in the facing side plates of the frame in front of the swing fulcrum in such a configuration that the front part of each control slit forms a narrow portion while the rear part of each control slit forms an upwardly enlarged portion, (e) a release bar extending in transverse direction to the lengthwise direction of the frame and having both ends disposed in the control slits in such manner that the release bar may slide on the hook plate, the release bar being always urged toward the narrow portion of the control slits by means of a spring positioned in rear of a supporter for the release bar so that when the release bar is positioned in the narrow portion of the control slits, the hook plate is pressed by the release bar against the ejector to secure locking of the tongue plate with the lock pawl, and (f) a manual operation assembly positioned in the front end of the buckle body and reciprocally slidable in the lengthwise direction of the buckle body when operated manually, so as to remove the release bar from the narrow portion to the upwardly enlarged portion in the control slits thereby cancelling the pressing of the release bar against the hook plate while disengaging the lock pawl from the tongue plate, wherein the release bar is shaped in a flat rectangular form in cross section and the supporter is positioned on the release bar in such a configuration that the supporter slides together with the release bar on the hook plate, integrally covering the release bar, and receives on the plane, including the swing fulcrum of the hook plate, the force of the spring positioned in rear of the supporter, and that the upwardly enlarged portion of each control slit forms a slanted edge in the front part thereof continuing to the front narrow portion, showing an arrangement such that when the release bar is disposed in the upwardly extended portion to swing the hook plate upwardly for unlocking the tongue plate, the release bar is contacted with the slanted edges so as to facilitate a downward swing of the hook plate, and wherein, the ejector is moved to the front end of the buckle body by the action of a spring positioned to the rear of the ejector in such a manner that the lower end of the lock pawl engaged with the tongue plate is attached to the upper part of the ejector.

2. The buckle according to claim 1, wherein the lock pawl has a slightly slanted front portion.

3. The buckle according to claim 1, wherein the ejector is mounted in such a configuration that it is slidable up to the front end of the buckle body where the opening for the tongue plate is formed with a cover for the buckle body.

4. The buckle according to claim 3, wherein the manual operation assembly has been shaped to form a tapered surface at the backwardly inclined lower front end thereof functioning as the upper part of the opening, while shaping the cover to have two facing side parts and the bottom part, each having a backwardly inclined tapered surface functioning as a side or upper part of the opening having a funnel-like structure.

5. The buckle according to claim 4, wherein the ejector contacts the manual operation assembly so that the ejector slidably moves together with the manual operation assembly in the lengthwise direction of the buckle body when the tongue plate is not inserted into the buckle body.

* * * * *